US006089782A

United States Patent [19]

Bligh et al.

[11] Patent Number: 6,089,782

[45] **Date of Patent: *Jul. 18, 2000**

[54] FRAME CATCHER ADAPTATION FOR GUARDRAIL EXTRUDER TERMINAL

[75] Inventors: Roger P. Bligh; Don L. Ivey, both of Bryan; Carl E. Buth, Wellborn; Hayes E. Ross, Bryan, all of Tex.

[73] Assignee: The Texas A&M University System, College Station, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/089,738

[22] Filed: Jun. 3, 1998

Related U.S. Application Data

[63] Continuation-in-part of application No. 08/729,182, Oct. 11, 1996, Pat. No. 5,791,812.

[51] Int. Cl.[7] ..... E01F 13/00; E01F 15/00; E01F 9/00; A01K 3/00

[52] U.S. Cl. ..... 404/6

[58] Field of Search ..... 256/13.1; 404/6, 404/9, 10

[56] References Cited

U.S. PATENT DOCUMENTS

| | | | |
|---|---|---|---|
| 2,154,818 | 4/1939 | Mayer . | |
| 2,776,116 | 1/1957 | Brickman . | |
| 3,643,924 | 2/1972 | Fitch | 256/13.1 |
| 3,661,359 | 5/1972 | Walker | 256/1 |
| 3,690,619 | 9/1972 | Kendall | 256/13.1 |
| 4,452,431 | 6/1984 | Stephens et al. | 256/13.1 |
| 4,655,434 | 4/1987 | Bronstad | 256/13.1 |
| 4,674,911 | 6/1987 | Gertz | 404/6 |
| 4,678,166 | 7/1987 | Bronstad et al. | 256/13.1 |
| 4,815,565 | 3/1989 | Sicking et al. | 188/32 |

(List continued on next page.)

FOREIGN PATENT DOCUMENTS

| | | |
|---|---|---|
| 0094846 | 11/1983 | European Pat. Off. . |
| 0431780A2 | 12/1991 | European Pat. Off. . |
| 2651811 | 3/1991 | France . |
| 1295582 | 5/1969 | Germany . |
| 38 09 470 A1 | 12/1989 | United Kingdom . |
| WO 8906721 | 7/1989 | WIPO . |

OTHER PUBLICATIONS

An End Treatment For Concrete Barriers Used In Work Zones, Texas Transportation Institute, State Department of Highways and Public Transportation; Research Report 262–2; Aug. 1982 (Rev. Feb. 1983)(19 pgs.).

*A Guide To Standardized Highway Barrier Hardware*; AASHTO–AGC–ARTBA Joint Committee, Subcommittee On New Highway Materials, Task Force 13 Report; (undated)(17 pgs.).

*Colorado Median Barrier End Treatment Tests*; R. G. Robertson and H. E. Ross, Jr., May 1981; (15 pgs.).

*Primary Examiner*—Eileen Dunn Lillis
*Assistant Examiner*—Gary S. Hartmann
*Attorney, Agent, or Firm*—Felsman, Bradley, Vaden, Gunter & Dillon LLP; Frank S. Vaden

[57] ABSTRACT

Apparatus and methods for preventing penetration of vehicles by causing the guardrail extruder terminal to contact and engage the frame or chassis of vehicles in a collision. In preferred embodiments, a guardrail extruder terminal end treatment is adapted for improved operation during impacts by attachment of a frame catcher penetration guard. The frame catcher adaptation extends below the usual lower edge of the impact head of the guardrail extruder terminal design in order to contact portions of the chassis of a vehicle during an impact at the guardrail end. In several embodiments, the impact head of a guardrail extruder terminal includes a substantially rigid downwardly extending portion which presents an expanded contact area, the location of which approximates the location of a portion of the vehicle's chassis. The frame catcher devices may be retrofitted onto existing guardrail extruder terminal impact heads.

16 Claims, 9 Drawing Sheets

U.S. PATENT DOCUMENTS

| | | | |
|---|---|---|---|
| 4,928,928 | 5/1990 | Buth et al. | 256/13.1 |
| 5,022,782 | 6/1991 | Gertz et al. | 404/6 |
| 5,078,366 | 1/1992 | Sicking et al. | 256/13.1 |
| 5,112,028 | 5/1992 | Laturner | 256/13.1 |
| 5,217,318 | 6/1993 | Peppei | 404/6 |
| 5,391,016 | 2/1995 | Ivey et al. | 404/6 |
| 5,407,298 | 4/1995 | Sicking et al. | 404/6 |
| 5,490,661 | 2/1996 | Stevens et al. | 256/13.1 |
| 5,660,496 | 8/1997 | Muller et al. | 404/6 |
| 5,733,062 | 3/1998 | Oberth et al. | 404/6 |
| 5,791,812 | 8/1998 | Ivey | 404/6 |

FRAME CATCHER ADAPTATION FOR GUARDRAIL EXTRUDER TERMINAL

CROSS-REFERENCE TO RELATED APPLICATIONS

This application is a continuation-in-part of application Ser. No. 08/729,182 entitled "Collision Performance Side Impact (Automobile Penetration Guard)," filed Oct. 16, 1996, now U.S. Pat. No. 5,791,812.

STATEMENT REGARDING FEDERALLY SPONSORED RESEARCH OR DEVELOPMENT

Not Applicable.

BACKGROUND OF THE INVENTION

1. Field of the Invention

The present invention relates to methods and apparatus for improved safety for end treatments on roadway guardrails. In particular, the present invention features an improvement upon the guardrail extruder terminal safety device.

2. Description of Related Art

Guardrails present a unique fixed object safety problem due to the raised ends which they sometimes present. Therefore, a number of guardrail end treatments have been developed which attempt to reduce the hazard presented by the raised ends. Guardrail end treatments seek to reduce the harmful effects of collisions with the ends of guardrails by absorbing, redirecting or cushioning impacts with the end of the rail. One popular end treatment is the guardrail extruder terminal, which is currently marketed commercially under the trade name ET-2000. The guardrail extruder terminal serves to attenuate impacts with the end of the guardrail and provides anchorage for impacts to the sides of the guardrail. In an end-on impact, the guardrail extruder terminal progressively flattens the beam of the guardrail and bends the flattened member in a curvilinear arc in a direction away from the colliding vehicle. Aspects of the guardrail extruder terminal have been described and claimed in U.S. Pat. No. 4,928,928, entitled "Guardrail Extruder Terminal," issued to Buth et al. on May 29, 1990, and U.S. Pat. No. 5,078,366, also entitled "Guardrail Extruder Terminal," issued to Sicking et al. on Jan. 7, 1992. Both of these patents have been assigned to the assignee of the present invention and are incorporated herein by reference. The ET-2000 is available commercially from Trinity Industries in Dallas, Tex. The guardrail extruder terminal features a generally vertically-oriented, rectangular striking plate or impact plate which will contact and engage an impacting vehicle. Normally, this plate is covered with a reflective material so that it is visible to an approaching vehicle.

As originally developed, the guardrail extruder terminal is constructed so that the lower edge of the front striking plate is located approximately 10–12" above the ground or roadway surface. At this height, however, the impact head may contact and engage a smaller impacting vehicle above its chassis or structural frame when impacted by this side of the vehicle. As a result, a smaller vehicle's superstructure can sustain damage from the impact head. Further, there is a risk that smaller vehicles having side door openings which are larger than the impact head may have the door punched through or punched out by the head during a collision in which the side of the vehicle impacts the head. A smaller car may even tend to wedge itself beneath the impact head in some situations, thus reducing or eliminating the advantage provided by the impact head in preventing penetration. This may occur, for example, if the guardrail extruder terminal is mounted toward the top of a convex slope, thereby leaving the lower edge of the head somewhat higher than is normal or desired for the terminal.

SUMMARY OF THE INVENTION

The present invention offers methods and apparatus for preventing penetration of vehicles by causing the guardrail extruder terminal to contact and engage the frame or chassis of even smaller vehicles in a collision.

In preferred embodiments of the invention, a guardrail extruder terminal end treatment is adapted for improved operation during impacts by attachment of a frame catcher penetration guard. The frame catcher adaptation extends below the usual lower edge of the impact head of the guardrail extruder terminal design in order to contact portions of the chassis of a vehicle during an impact at the guardrail end. In several embodiments, the impact head of a guardrail extruder terminal includes a substantially rigid downwardly extending portion which presents an expanded contact area, the location of which approximates the location of a portion of the vehicle's chassis.

In an alternative embodiment, a frame is provided which is affixed to a standard impact head. The frame includes a downwardly extending portion which presents the expanded contact area. The frame is also designed to be greatly collapsible when impacted from a substantially end-on direction. However, when impacted from a direction other than substantially end-on, such as a glancing impact direction, the frame is substantially non-collapsible and maintains its integrity. The frame includes an outer housing which defines a central opening. The housing is formed of a unitary outer of sheet metal which surrounds the central opening. In another described embodiment, the impact head itself is fabricated in such a manner that it extends downward to within four to six inches from the ground.

The frame catcher devices described may be readily retrofitted onto existing guardrail extruder terminal impact heads.

DETAILED DESCRIPTION OF THE PREFERRED EMBODIMENTS

The methods and apparatus of the present invention have been developed for and are primarily directed toward use with guardrail extruder terminal end treatments for guardrail installations. For the sake of clarity, like components among the various embodiments described are numbered alike.

Figure 1:
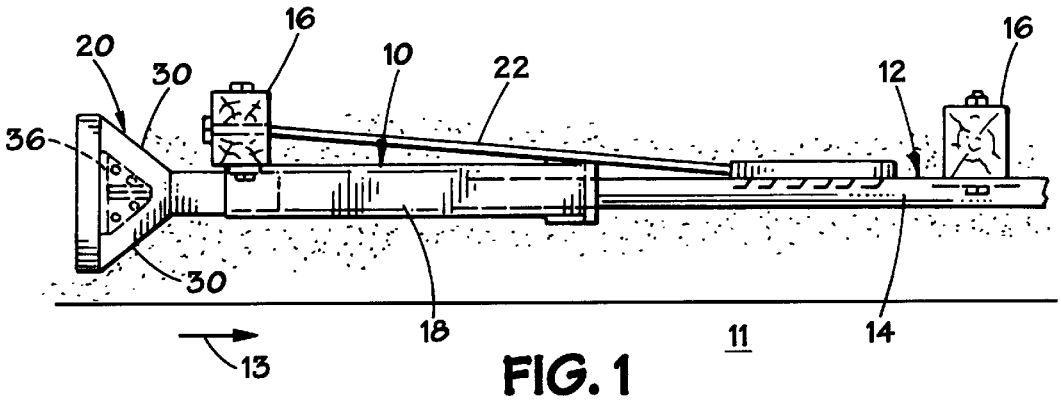
FIG. 1 is a plan view of an exemplary guardrail end equipped with a guardrail extruder terminal device which incorporates a frame catcher constructed in accordance with one preferred embodiment of the invention.
Figure 2:
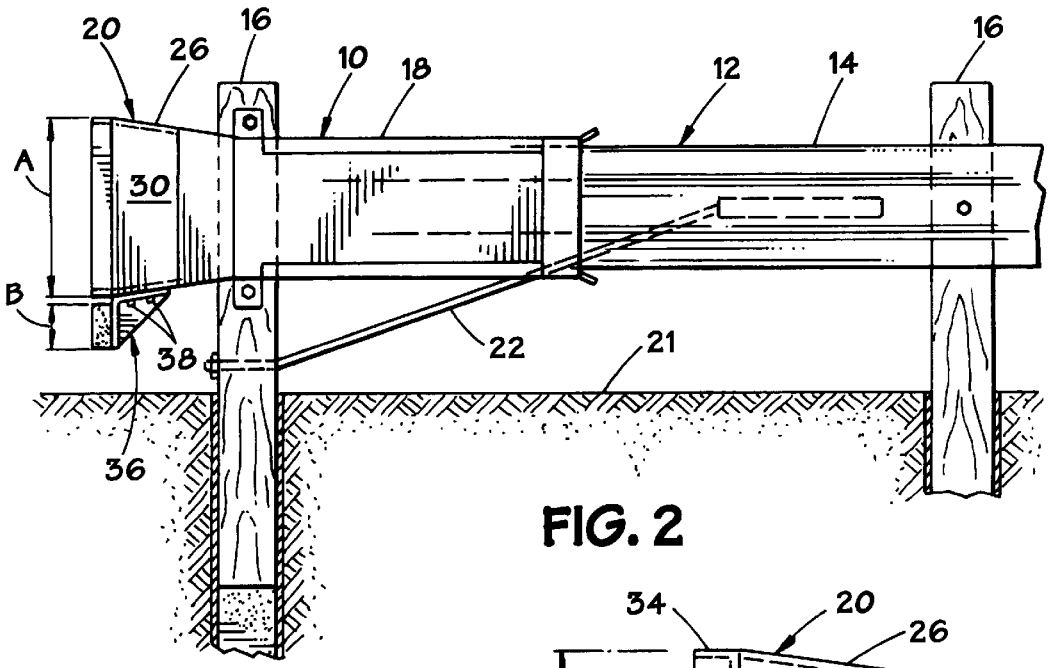
FIG. 2 is a side view of the guardrail end of FIG. 1.
Figure 3:
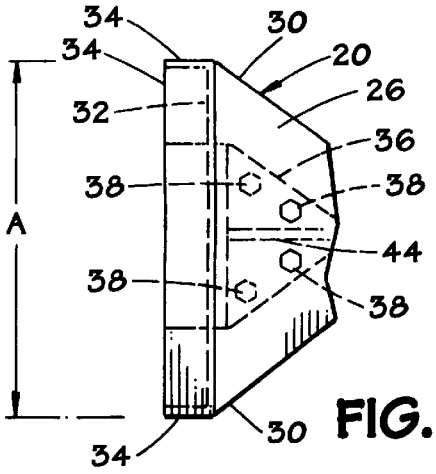
FIG. 3 is an enlarged plan view of the head assembly for the penetration guard of FIGS. 1 and 2.

A first embodiment of the invention may be understood with reference to FIGS. 1–3, an exemplary guardrail extruder terminal device 10 has been installed onto the upstream end of a guardrail installation 12 along a roadway lane 11 along which vehicular traffic travels. The terms "upstream" and "downstream," as used herein, are references to the direction of expected vehicle traffic along the roadway lane 11. In FIG. 1, traffic travels in the direction of arrow 13—from upstream to downstream. In accordance with this convention, components of the guardrail installation 12 can be referred to as being located upstream or downstream from other components.

The guardrail installation 12 includes a horizontal corrugated rail 14 mounted upon a plurality of support posts 16. A rod or cable assembly 22 extends from an intermediate portion of the rail 14 down to and through a lower portion of the lead support post 16. In some embodiments, such as that depicted in FIGS. 9 and 10, horizontal strut 24 extends between the two upstream posts 16.

Figure 4:
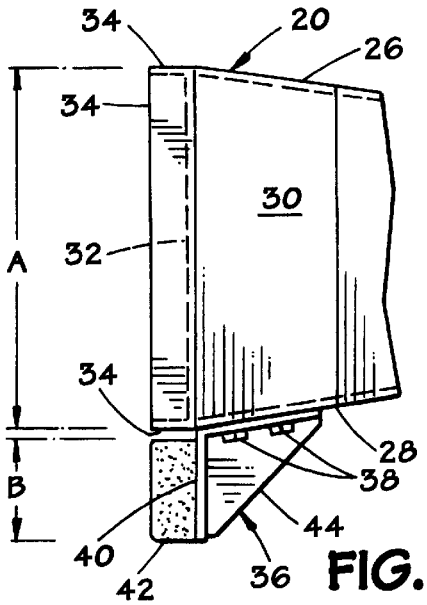
FIG. 4 is an enlarged side view of the head assembly in FIG. 3.
Figure 5:
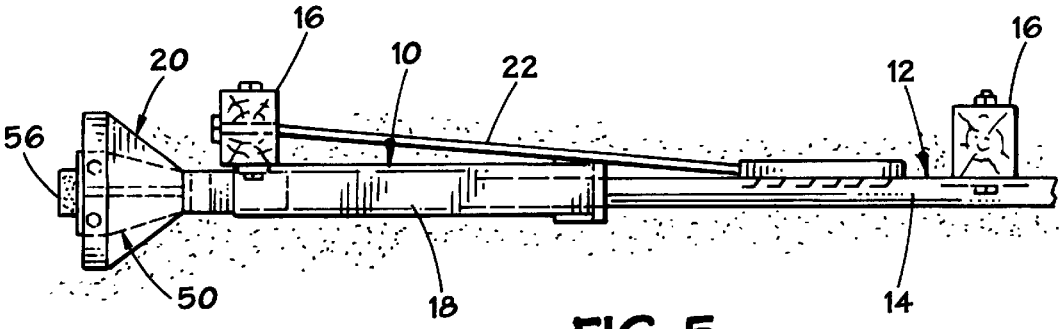
FIG. 5 is a plan view of a guardrail end with a guardrail extruder terminal device and an alternative frame catcher device.
Figure 6:
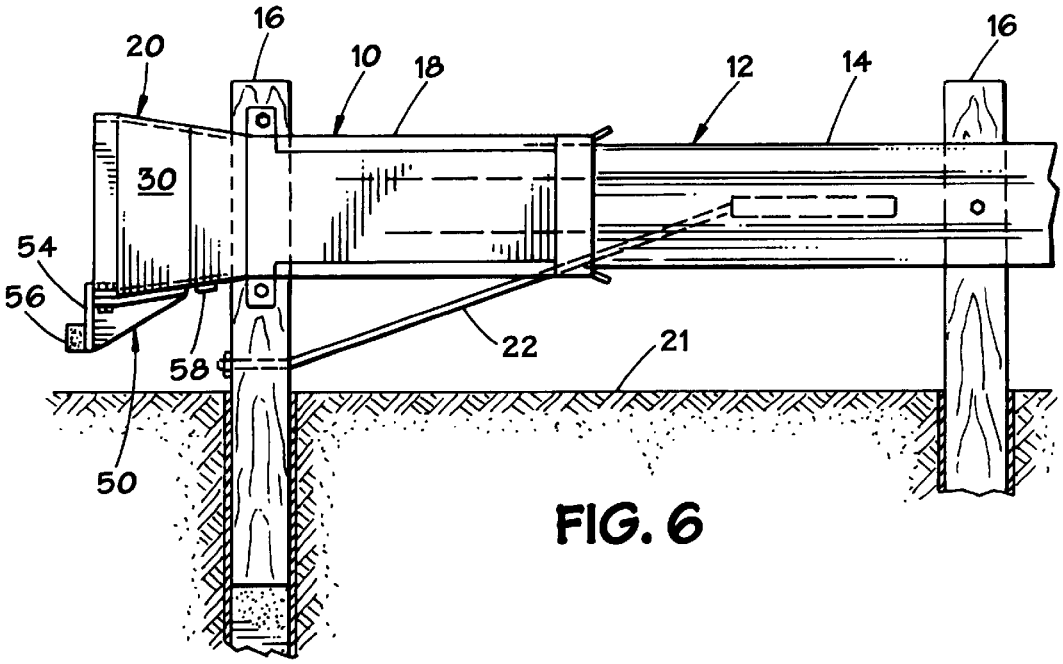
FIG. 6 is a side view of the arrangement shown in FIG. 5.
Figure 7:
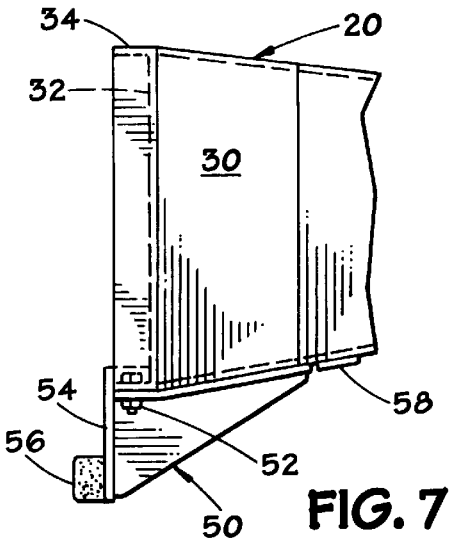
FIGS. 7 and 8 are enlarged side and plan views of the exemplary frame catcher device depicted in FIGS. 5 and 6.
Figure 8:
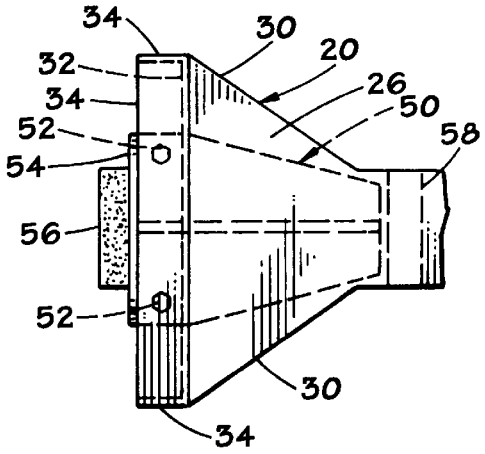
Figure 21:
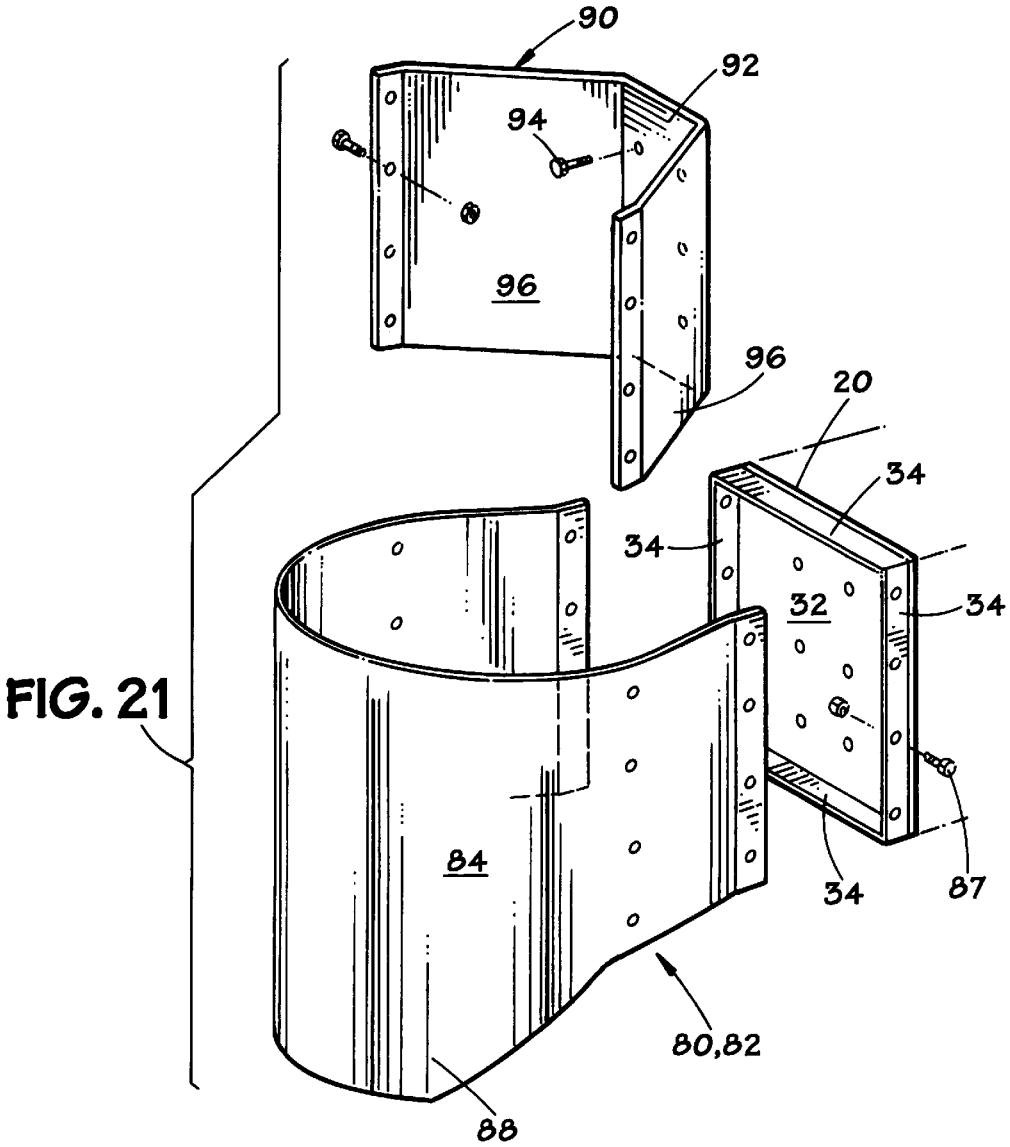
FIG. 21 is an exploded view of components of the frame catcher shown in FIGS. 17–20.

The guardrail extruder device 10 features a guide 18 which is slidingly received upon the rail end 14 and an impact head 20 of standard size and dimensions. Structure and operation of the guardrail extruder device 10, except as described otherwise herein, is generally described in U.S. Pat. Nos. 4,928,928 and 5,078,366. As described in greater detail there, the guardrail extruder device 10 will flatten and bend the corrugated rail during a collision and extrude the rail away from the impacting vehicle. The head 20 is usually formed of iron, steel or a suitable durable alloy and presents a top face 26, bottom face 28 and two side faces 30 which diverge from the sleeve 18 and terminate at striking face 32 which is oriented generally vertically and faces upstream. As best seen in FIGS. 3, 4 and 21, the upstream striking face 32 is bordered by four flanges 34. The striking face 32 is customarily painted or covered with reflecting material. With the present invention it is preferred that the guide 18 be longer than that used in a standard guardrail extruder device so as to offset any bending moment effect which might be associated with the use of a lower or extended contact area of the type which will be described. It is currently preferred that the length of the guide 18 be increased from two to three feet or perhaps as much as 100% in length.

The striking face 32 presents an upper contact area "A", which approximates the height and width of the upstream end of the head 20. The upper contact area "A" is located so that it generally engages upper portions of an impacting smaller vehicle located above the frame or chassis. For example, the upper contact area "A" would be expected to contact portions of the door of a smaller vehicle in a side impact scenario. In a typical guardrail extruder terminal installation, the upper contact area "A" would present a height of 20.5 inches and a width of 20 inches and be located so that the lower edge of the contact area is approximately from 10.6–11.4 inches above the ground 21.

A frame catcher 36 is affixed by bolts 38 to the bottom face 28 of the head 20. The frame catcher 36 includes an upstream-facing supplementary contact face 40 which is covered by an elastomeric pad 42. As may be seen in FIGS. 2 and 4, the contact face 40 presents a lower contact area "B." The lower contact area "B" is disposed below the upper contact area "A." The lower contact area "B" is preferably the same width as the striking face 32 or head 20 and is located so as to engage portions of the frame or chassis of an impacting vehicle. It is presently preferred that the lower contact area "B" extend downward to within four to six inches from the ground. A cross brace, or longitudinal fillet, 44 supports the contact face 40.

Figure 24:
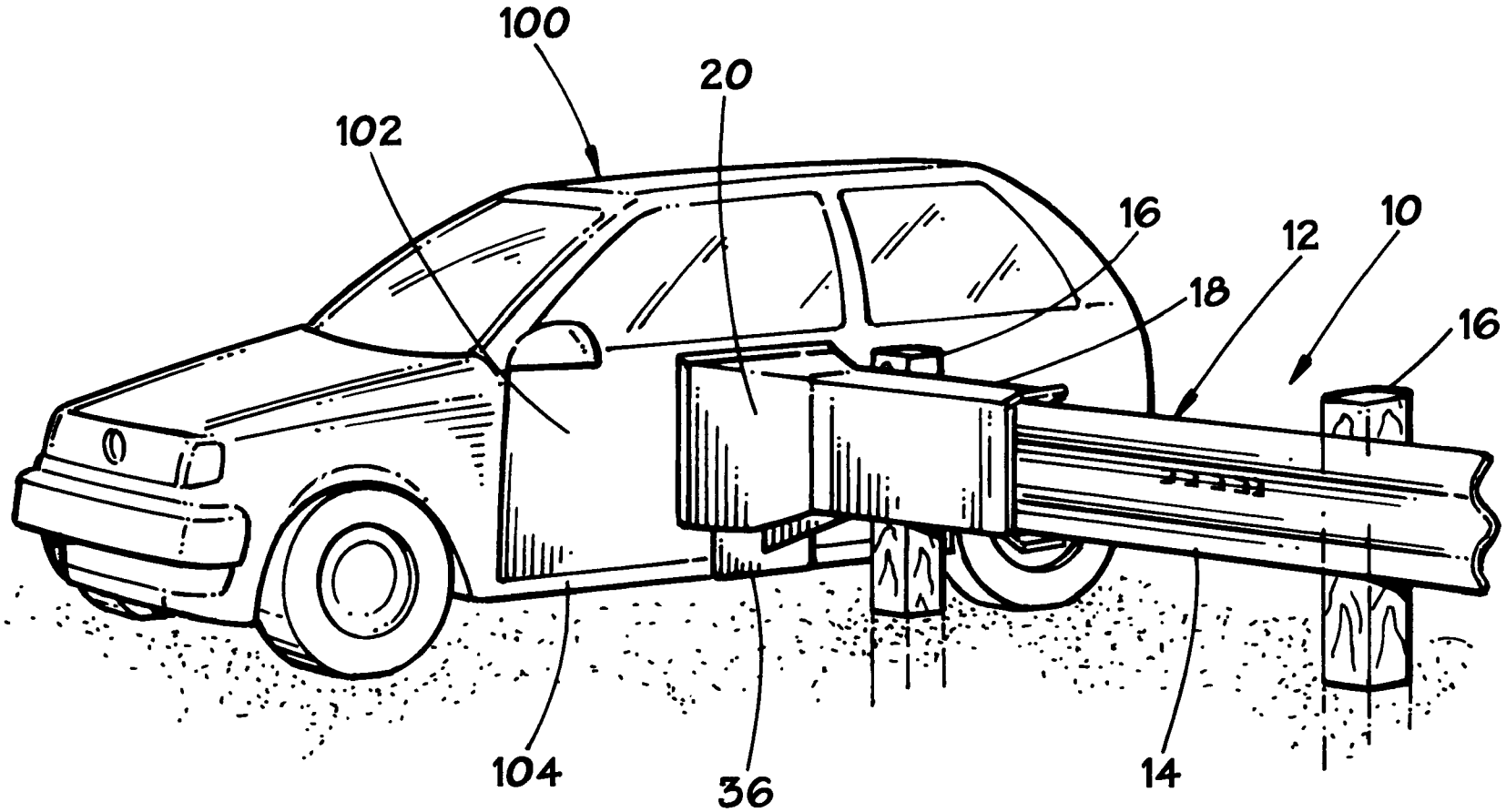
FIG. 24 depicts the engagement characteristics of a guardrail extruder terminal equipped with an exemplary frame catcher device.

The frame catcher 36 is located and adapted so that its lower contact area "B" will engage the frame of a smaller impacting vehicle. This is illustrated graphically by FIG. 24, wherein an exemplary small car 100 is shown in juxtaposition to the guardrail installation 12 with the installed extruder terminal device 10. The frame catcher 36 is shown installed on the impact head 20. As may be seen, the impact head 20 is aligned generally with the door 102 of the small car 100. The frame catcher 36, however, is aligned generally with the chassis or frame portion 104 of the small car 100. The chassis or frame portion 104 is the structurally supporting portion of the small car 100 onto which the body of the small car 100 is mounted. As a structural component, the chassis or frame portion 104 is typically stronger and significantly more resistant to crushing, bending and deformation than the body of a vehicle, including the door 102. Due to the presence of the frame catcher 36, therefore, the small car 100 should not be penetrated by the impact head 20 during a side collision.

Referring now to FIGS. 5–8, an alternate embodiment is illustrated. A frame catcher 50 is affixed to flange 34 of the head 20 by bolts 52. The frame catcher 50 also features an upstream-facing contact face 54. An elastomeric pad 56 is affixed to the contact face 54. A stop bar 58 is affixed to the lower side of the impact head 20. The stop bar 58 helps prevent rotation of the frame catcher 50 with respect to the head 20 during an impact. The stop bar 58 may be either welded or bolted to the head 20.

Figure 9:
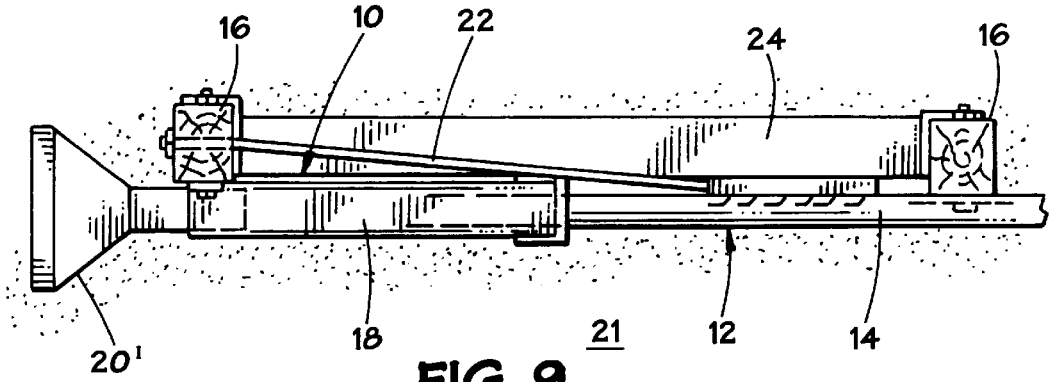
FIG. 9 is a plan view of a guardrail end with a guardrail extruder terminal device and another alternative frame catcher device.
Figure 10:
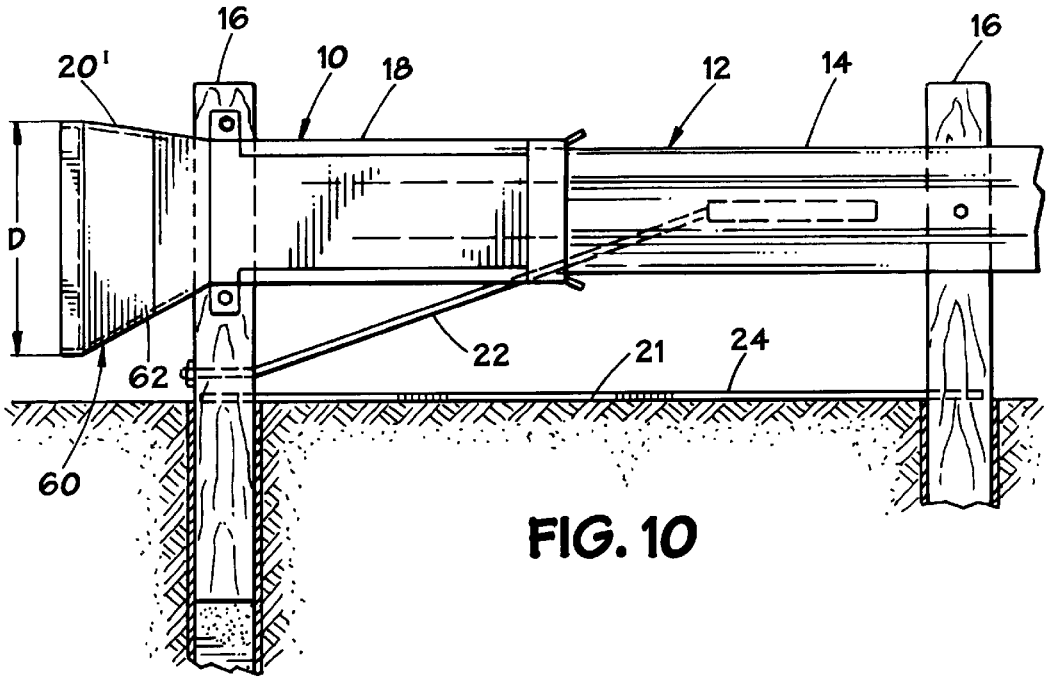
FIG. 10 is a side view of the arrangement shown in FIG. 9.
Figure 11:
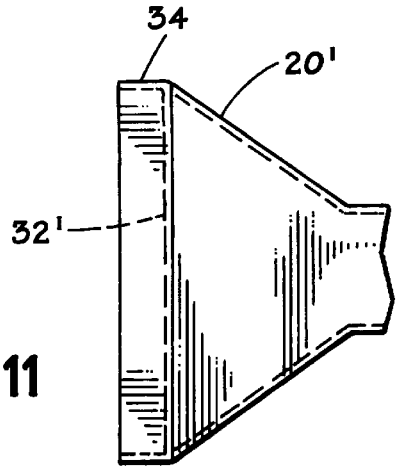
FIGS. 11 is an enlarged plan view of the exemplary head depicted in FIGS. 9 and 10.
Figure 12:
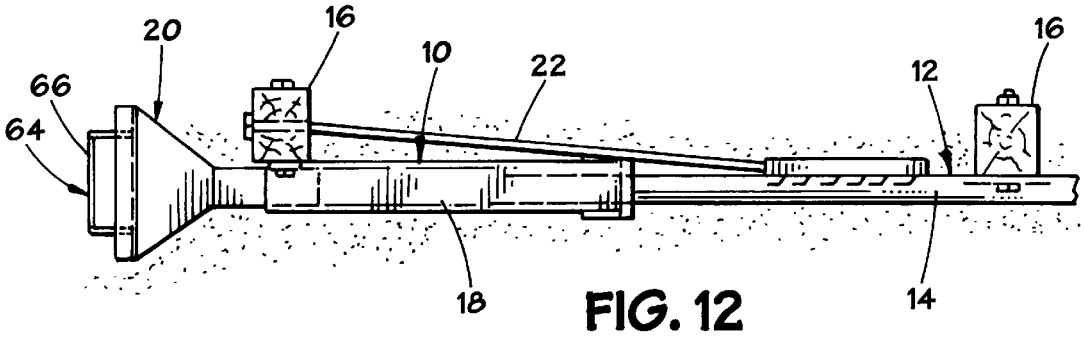
FIG. 12 is a plan view of a guardrail end with a guardrail extruder terminal device and a further alternative frame catcher device.

Referring to FIGS. 9–11, yet another alternate embodiment is shown. A frame catcher, generally shown as 60 in FIG. 10 is provided by an integrally-formed head 20' which has an extended height "D." The extended height "D" is created by a downwardly extending portion 62 which extends much further toward the ground 21 than the lower portion of the standard impact head 20. The overall height "D" of the head 20' generally corresponds to the combined heights of areas "A" and "B" described earlier. A conventional guardrail extruder terminal installation could be easily retrofitted with a frame catcher 60 by replacing a standard impact head with a head having an extended height "D."

Figure 13:
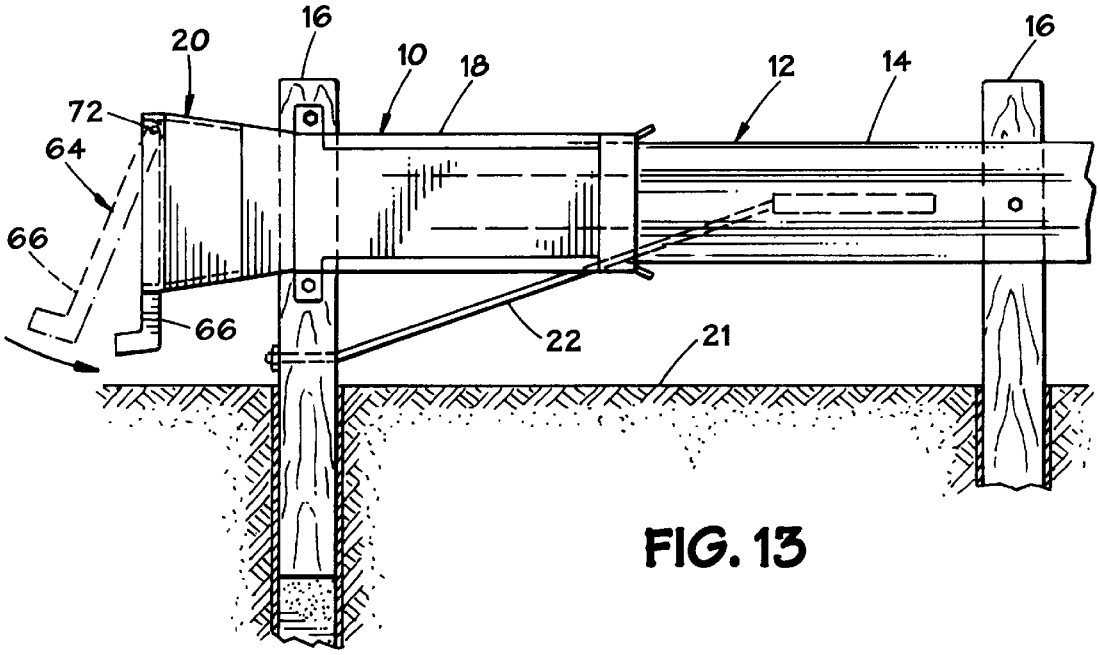
FIG. 13 is a side view of the arrangement shown in FIG. 12.
Figure 14:
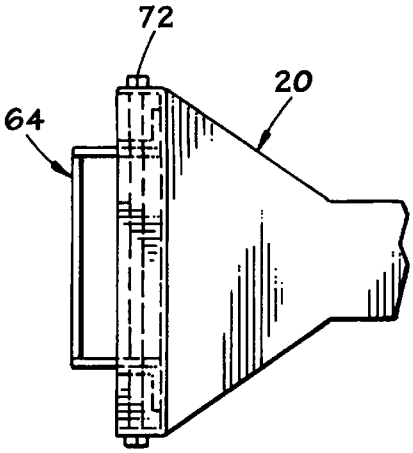
FIGS. 14 and 15 are enlarged plan views of the head and frame catcher device depicted in FIGS. 12 and 13.
Figure 15:
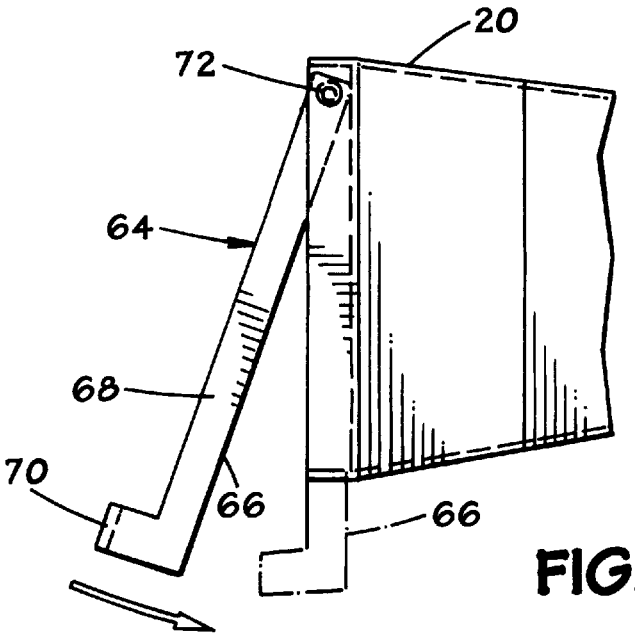
Figure 16:
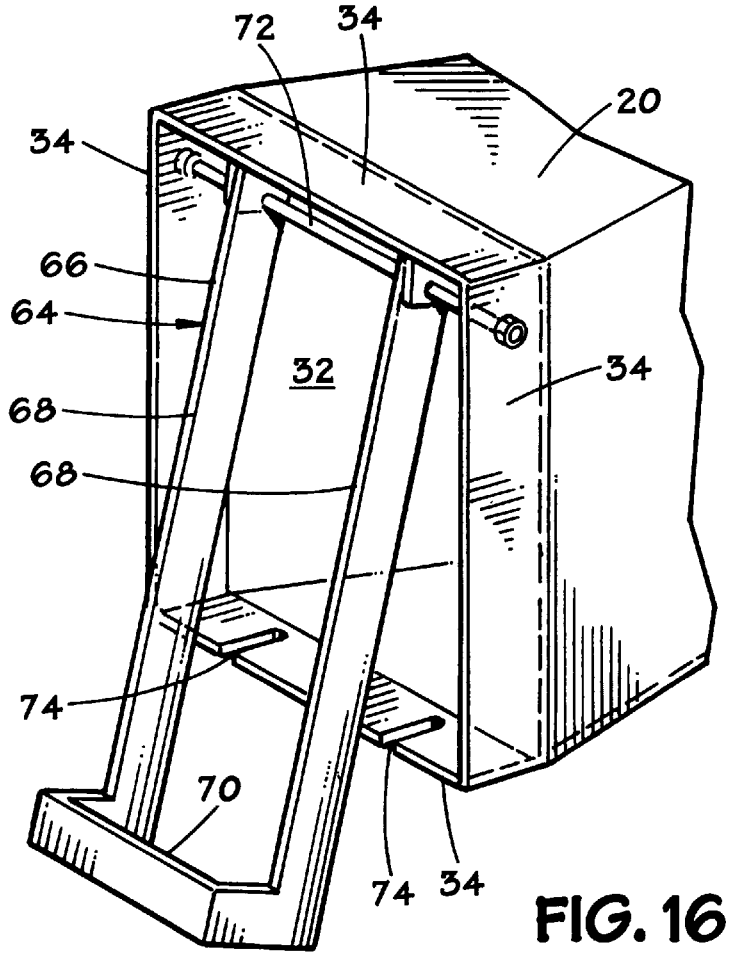
FIG. 16 is an isometric view of the device depicted in FIGS. 12–15.
Figure 17:
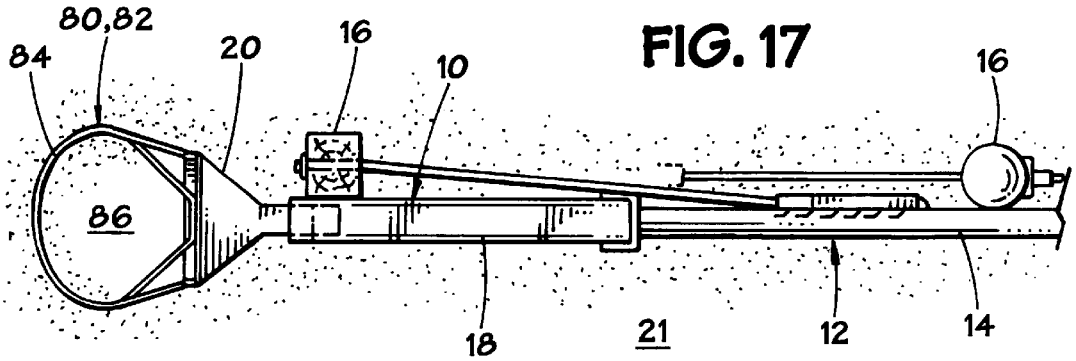
FIG. 17 is a plan view of still another alternate embodiment for a frame catcher device incorporated with an exemplary guardrail extruder terminal.
Figure 18:
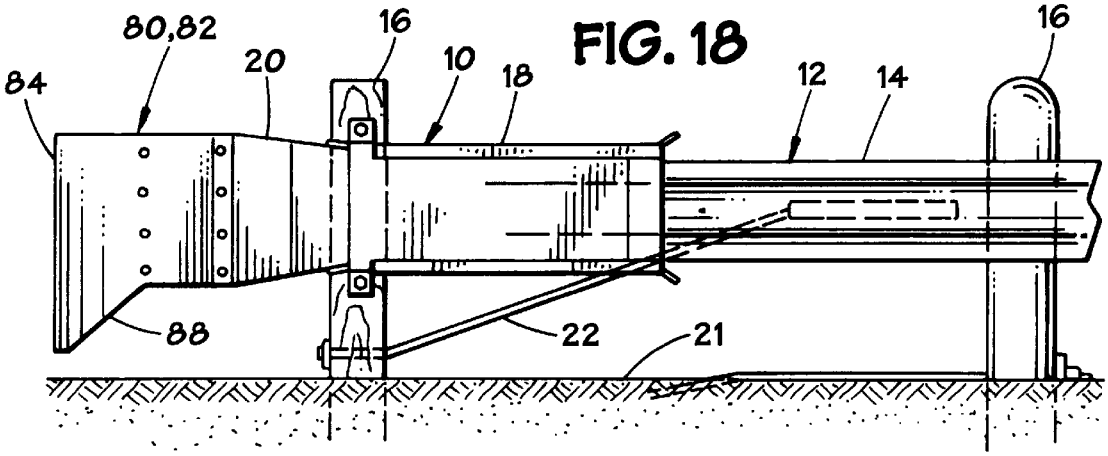
FIG. 18 is a side view of the apparatus shown in FIG. 17.
Figure 19:
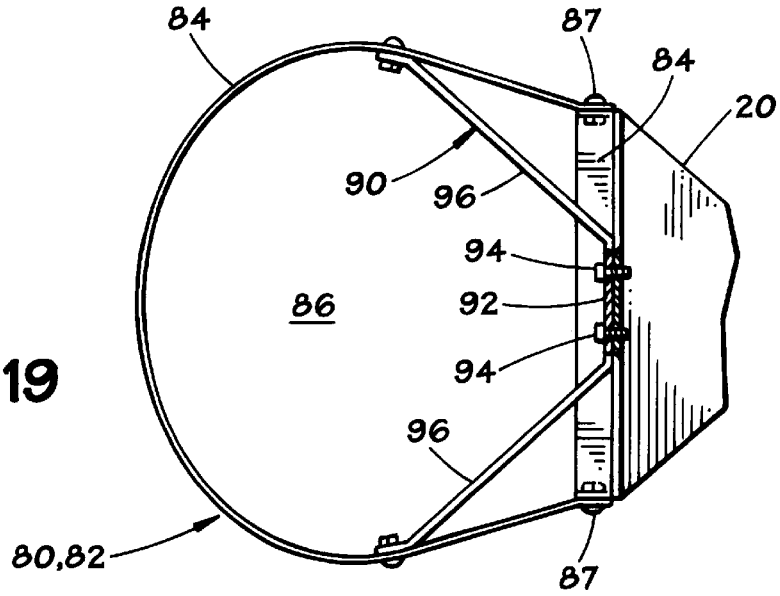
FIG. 19 is an enlarged plan view of the head and frame catcher shown in FIGS. 17–18.
Figure 20:
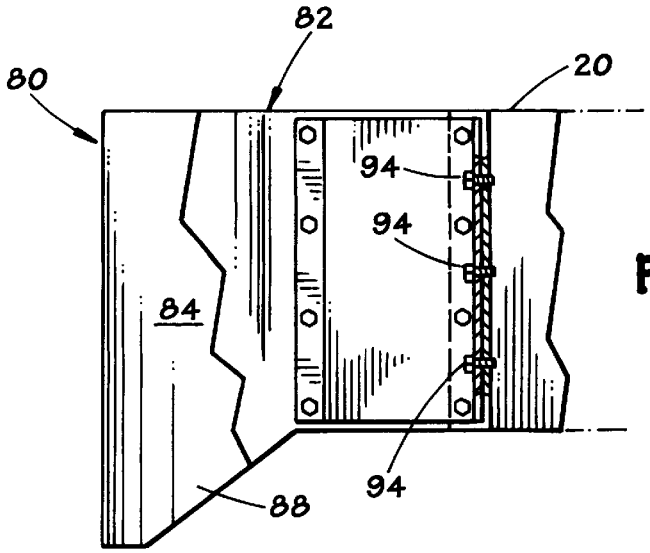
FIG. 20 is an enlarged side view of the head and frame catcher shown in FIGS. 17–19.

Referring to FIGS. 12–15, still another embodiment of the invention is depicted. In this embodiment, a standard impact head 20 is supplied with a frame catcher 64 which is formed of a bracket 66 having a pair of generally vertically oriented arms 68 which are each interconnected with one another at one end by a cross-piece 70. The other end of the arms 68 are affixed to the flanges 34 of the impact head 20 by a dowel or bar 72. As FIGS. 13, 15 and 16 illustrate, the bracket 66 is capable of pivoting at the dowel or bar 72 so that it can swing outward from the striking face 32 of the head 20. A pair of slots 74 (see FIG. 16) are cut into the lower flange 34 to receive and accommodate the arms 68 of the bracket 66 when the bracket 66 is pivoted toward the striking face 32.

Referring now as well to FIGS. 17–21, a further exemplary frame catcher apparatus 80 is shown which features a collapsible frame 82 that includes a unitary sheet metal shell 84. The sheet metal is preferably of #10 gage material, however, other suitable thicknesses or gages may be used. The sheet metal shell 84 is bent or formed to surround a central opening 86. The shell 84 is then affixed to a standard guardrail extruder terminal impact head 20 by means of suitable connectors 87. It is presently preferred that the connectors 86 comprise a headless, or round-head, bolt and nut arrangement as the headless nature of the round head bolt presents a smooth appearance and reduces the number of sharp edges or protrusions. The shell 84 is formed so that at least a portion 88 extends downwardly toward the ground 21 below the lower edge of the striking face 32 of the impact head 20. The downwardly extending portion 88, serves as a "frame catcher" because it provides a contact area below the level afforded by the striking face 32.

The frame 82 also includes a brace piece 90. The brace piece 90 is preferably formed of ¼" steel plate or plate sections, but other suitable plate thicknesses and materials may be used. The brace piece 90 is generally fashioned to be sturdier than the shell 84, which is made of sheet metal. The brace piece 90 is made up of a central attachment section 92 through which connectors 94 are disposed to affix the brace piece 90 to the striking face 32 of the head 20. Two wing braces 96 extend laterally from the central attachment section 92 and are affixed at their opposite ends to portions of the sheet metal shell 84. The brace piece 90 provides some support to the frame 82 against premature collapse and, because the brace piece 90 is sturdier than the shell 84, it provides lateral support if the frame 82 is impacted upon its longitudinal side as would occur if there is a grazing or glancing impact of the terminal by a vehicle. However, if the frame 82 is impacted substantially from the end, the frame 82 should readily collapse in a manner which will be described.

Particularly during an impact where the side of a smaller vehicle impacts the end of a guardrail assembly, the frame catcher 88 will contact and engage the chassis portion of the vehicle. Engagement of the vehicle chassis results in a more effective stop of the vehicle with a minimum of damage to the superstructure of the vehicle. The use of a sleeve 18 having an extended length will offset or reduce the effect of a bending moment caused by an off-center impact to the downwardly extending portion 88. A sufficiently strong bending moment might degrade the ability of a shorter sleeve to move along the guardrail end in the manner intended during an impact.

Figure 22:
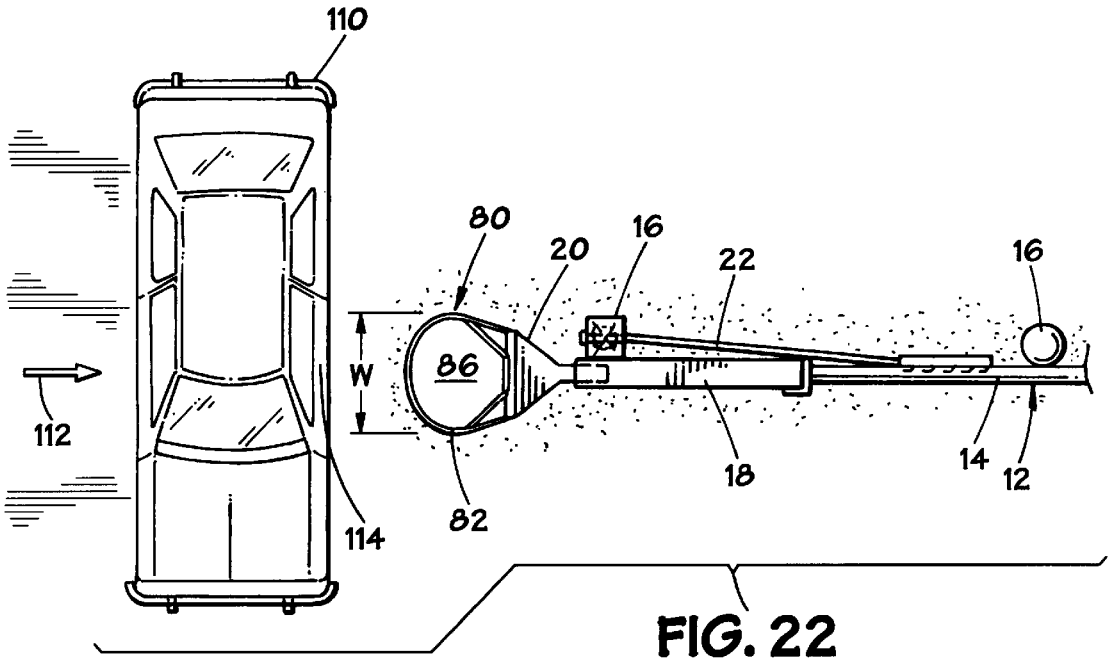
FIGS. 22 and 23 depict a side impact collision of a vehicle with the apparatus depicted in FIGS. 17–21.
Figure 23:
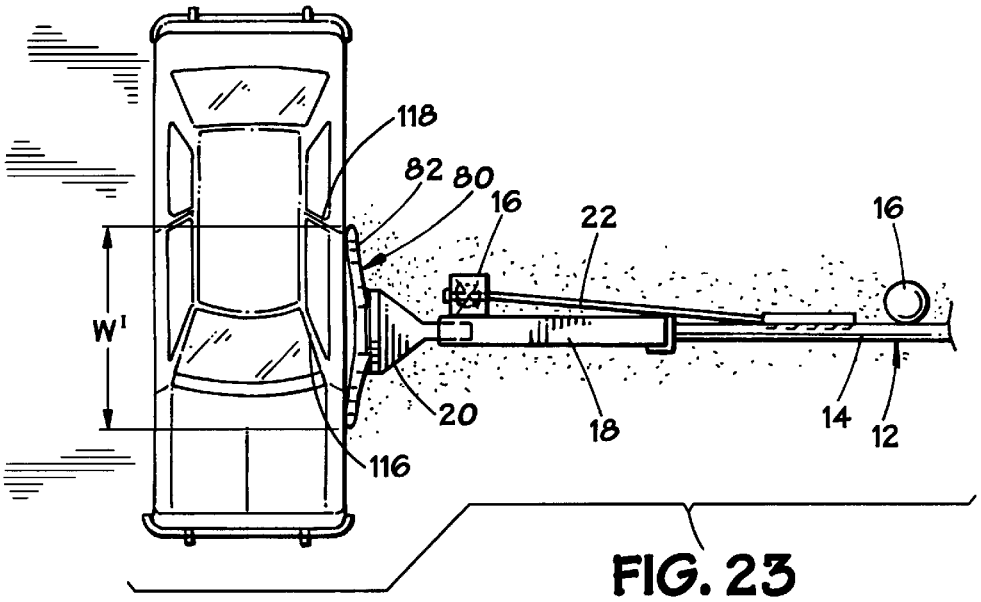

Upon an end impact, the frame 82 will deform so as to expand laterally outward forming a wide barrier to penetration of the doorway by the object, as depicted by FIGS. 22 and 23. Prior to impact, the frame 82 presents an end-on impact area of reduced width or "w" in FIG. 22. A preferred range of reduced widths, w, is generally from approximately 2 feet to approximately 4 feet. A particularly preferred reduced width, w, is approximately 2½ feet. During an end-on collision, the frame 82 deforms so that a second end-on impact area of greater width, w', in FIG. 23, is provided. The width of the second expanded impact area, w' approaches and may exceed the width of space between the "A" and "B" door pillars for a vehicle. Preferably, the width of the second expanded area, w', is about four feet.

If desired, the central opening 86 may be filled with a readily deformable, energy-absorbent material or member such as aluminum cans. Alternative filler materials or members include styrofoam peanuts and ultra low strength concrete.

Now referring to FIGS. 22–23, operation of this apparatus is further illustrated. In FIG. 22, an automobile 110 is shown approaching the guardrail assembly 12 in the general direction indicated by arrow 112 so as to result in an end-on impact to the guardrail assembly 12. Further, the automobile 110 is oriented such that the driver's side door 114 is facing the guardrail assembly 12 and makes a probable point of impact with the guardrail assembly 12. The driver's side door 114 is framed on either side by door pillars 116 and 118 (commonly referred to as the "A" and "B" pillars).

FIG. 23 illustrates the automobile 110 and the guardrail assembly 12 during the initial portion of the impact between them. As the impact develops further (in a manner not described in detail herein), the extruder head will begin to flatten and bend portions of the guardrail. Further details concerning this aspect of the impact are described in U.S. Pat. No. 4,928,928, entitled "Guardrail Extruder Terminal," issued to Buth et al. on May 29, 1990, and U.S. Pat. No. 5,078,366, entitled "Guardrail Extruder Terminal," issued to Sicking et al. on Jan. 7, 1992 which have been incorporated herein by reference. As FIG. 23 shows, the frame 82 is essentially flattened so that it presents an expanded width area as described previously.

Those skilled in the art will recognize that while the invention has been herein shown and described in what is presently believed to be the most practical and preferred embodiments thereof, many modifications may be made to the invention described while remaining within the scope of the claims.

What is claimed is:

1. An impact head for a guardrail extruder terminal located on an area of ground, comprising:

a. a striking plate, the striking plate presenting a first strike face having a first contact area; and b. a second strike face disposed below the first strike face and having a second contact area adapted to contact and engage a portion of a frame of an impacting vehicle, the second contact area extending downward and terminating above the ground.

2. The head of claim 1 wherein the second strike face is formed by an extension member which is affixed below the striking plate.

3. The head of claim 2 wherein the impact head further comprises a flange adjacent the first strike face, and the extension member is affixed to the flange.

4. The impact head of claim 1 wherein the first and second contact areas are contiguous.

5. The head of claim 4 wherein the first and second contact areas are unitarily formed.

6. The head of claim 1 further comprising an elastomeric bumper pad affixed to the second strike face.

7. The head of claim 1 further comprising a guide adapted to receive a guardrail end, said guide having an extended length to reduce a bending moment from impact upon said second strike face.

8. An extension member for attachment to the impact head of a guardrail extruder terminal located on an area of ground, the extension member comprising:

a second strike face presenting a contact area adapted to adjoin a first strike face of the impact head and to contact and engage frame portions of an impacting vehicle the second strike face extending downwardly from the impact head and terminating above the ground.

9. The extension member of claim 8 wherein the second strike face comprises a rigid striking plate.

10. The extension member of claim 9 further comprising an elastomeric bumper pad affixed to the striking plate.

11. The extension member of claim 9 further comprising a support member which supports the striking plate.

12. The extension member of claim 8 wherein the second strike face is presented by a collapsible frame formed of a sheet metal shell.

13. A guardrail installation located on an area of ground comprising:

a. a corrugated guardrail presenting a guardrail end;

b. a guardrail extruder terminal impact head disposed upon said guardrail end and adapted to bend and flatten said guardrail during an impact, the impact head presenting a first contact area; and c. a supplemental second contact area adjoining and disposed below the first contact area, the second contact area terminating above the ground.

14. The guardrail installation of claim 13 further comprising a guide associated with the impact head and adapted to receive the guardrail end, the guide having an extended length adapted to offset a bending moment resulting from an impact to the second contact area.

15. An extension member for attachment to the impact head of a guardrail extruder terminal, the extension member comprising a supplemental strike face presenting a contact area adapted to adjoin a strike face of the impact head and to contact and engage frame portions of an impacting vehicle, the supplemental strike face comprising a bracket that is pivotally affixed to a portion of the impact head.

16. The extension member of claim 15 wherein the bracket comprises a pair of arms that are interconnected by a cross-piece.

* * * * *